United States Patent [19]

Buhler

[11] 4,272,847

[45] Jun. 16, 1981

[54] BASEBALL PLAYER'S CHEST PROTECTOR

[76] Inventor: William J. Buhler, 2210 McNab Ave., Long Beach, Calif. 90815

[21] Appl. No.: 34,650

[22] Filed: Apr. 30, 1979

[51] Int. Cl.[3] ..... A41D 13/00

[52] U.S. Cl. ..... 2/2

[58] Field of Search ..... 2/2, 2.5, 16, 22, 24

[56] References Cited

U.S. PATENT DOCUMENTS

| | | | |
|---|---|---|---|
| 1,970,130 | 8/1934 | Dickenson | 2/2 |
| 2,756,429 | 7/1956 | Malachowski | 2/2 |
| 3,076,197 | 2/1963 | Glahe | 2/2 |
| 3,125,762 | 3/1964 | Glahe | 2/2 |
| 3,248,738 | 5/1966 | Morgan | 2/2 |
| 3,574,861 | 4/1971 | Hale | 2/2 |

*Primary Examiner*—H. Hampton Hunter
*Attorney, Agent, or Firm*—William C. Babcock

[57] ABSTRACT

A lightweight baseball catcher's chest protector that permits circulation of air to the user's body, one that does not absorb perspiration even after prolonged useage, has a minimum restrictive action on the movement of the user thereof, and minimizes the tendency of a missed baseball that strikes the chest protector to bounce therefrom in an unpredictable direction. The chest protector is adapted for use not only by a catcher but also an umpire. The protective pad of the present invention is of sufficient size to at least cover the chest of a user, and is defined by an organic foamed material that is pliable and laterally deformable when a portion thereof is struck by a baseball. The foam material after being struck by a baseball returns but slowly to its initial configuration and as a result there is no tendency of a missed baseball to strike the protector to bounce therefrom. The protective pad may have a number of spaced openings extending laterally therethrough that serve not only to lighten the pads, but also to permit substantial circulation of air through the pad to the user's body. The pad is enveloped in a film of pliable polymerized resin that is water impervious, and as a result the pad has no tendency to absorb perspiration from a catcher or a user even after prolonged useage.

6 Claims, 6 Drawing Figures

BASEBALL PLAYER'S CHEST PROTECTOR

BACKGROUND OF THE INVENTION

1. Field of the Invention

Baseball Player's Chest Protector.

2. Description of the Prior Art

Professional and semi-professional baseball catchers invariably wear chest protectors. Such chest protectors in the past have been formed from a fabric material that encloses a baseball impact absorbing material, but such protectors are relatively resilient, and as a result a missed baseball after striking the protector may bounce therefrom in an unpredictable direction that precludes the catcher making a quick recovery thereof.

A major object of the present invention is to provide a baseball catcher's chest protector that will be lighter in weight than those previously available, will have a minimum restrictive effect in impeding the movement of a catcher, will deaden the movement of a baseball that inadvertently strikes the protector and cause the baseball to drop to the ground adjacent the catcher rather than bouncing away from the protector in an unpredictable direction, and can permit circulation of air through the protector to the user's body, and due to a water impervious film that envelops the chest protector, the chest protector will not absorb perspiration from a user even after the protector has been used as such for a prolonged period of time.

SUMMARY OF THE INVENTION

A baseball catcher's chest protector that includes a protective pad of substantial heighth and width that covers at least the chest of a catcher, and is removably held on the catcher by a harness that extends over the shoulders and partially around the waist of a user. The protective pad is preferably formed of a lightweight foamed organic material in which the portion struck by a baseball deforms laterally, and but slowly returns to its initial configuration. Due to the slow recovery of the foamed material to its initial configuration, there is little tendency of a missed baseball to bounce from the protector in an unpredictable direction, but rather for the baseball to drop to the ground adjacent the catcher where it may be easily recovered.

Due to the light weight of the chest protecting portion of the invention, and the pliability thereof, the chest protector has a minimum effect in impeding the movement of a catcher or umpire that may be wearing the same. The chest protector preferably has a number of horizontal and vertically spaced openings of substantial size formed therein, to permit circulation of air through the protector to the catcher's body to minimize any discomfort in wearing the protector, and the openings also serving to lighten the weight of a chest protector. The foam material is preferably enveloped in an envelope of a pliable polymerized vinyl or other suitable synthetic resins, which envelope is impervious to water, and as a result the protector absorbing a minimum of perspiration from a user even after the protector has been in use for a prolonged period of time.

DESCRIPTION OF THE PREFERRED EMBODIMENT

Figure 1:
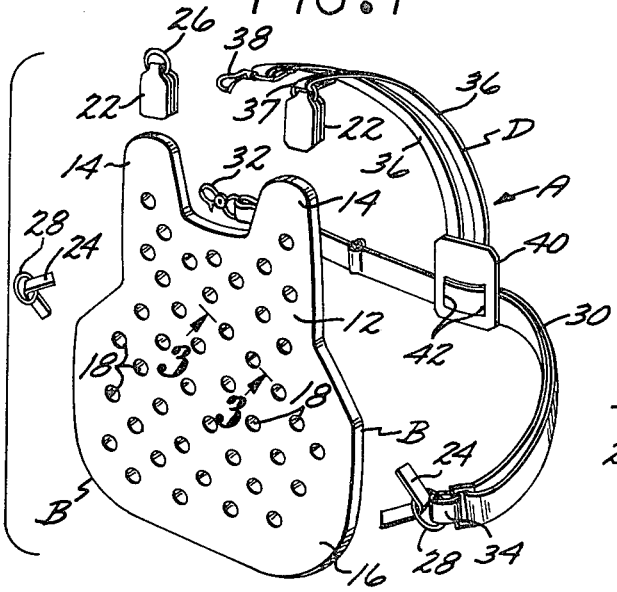
FIG. 1 is a perspective view of the components comprising the catcher's protective chest protector.
Figure 2:
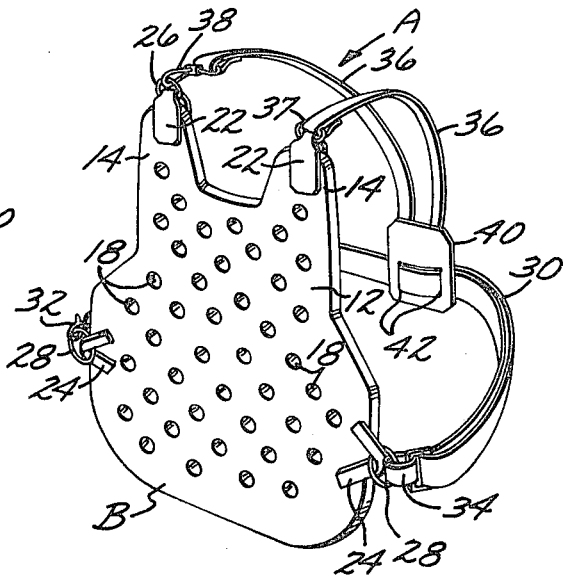
FIG. 2 is a perspective view of the chest protector in an assembled form.
Figure 4:
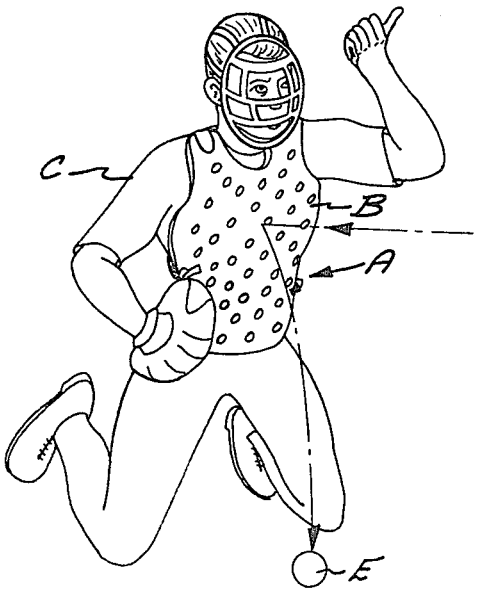
FIG. 4 is a perspective view of a catcher's protective chest protector disposed on a user.

The baseball catcher's chest protector A as may be seen in FIGS. 1 and 2 includes a protective pad B of novel structure that is supported on a catcher C as as illustrated in FIG. 4 by a harness D.

Figure 5:
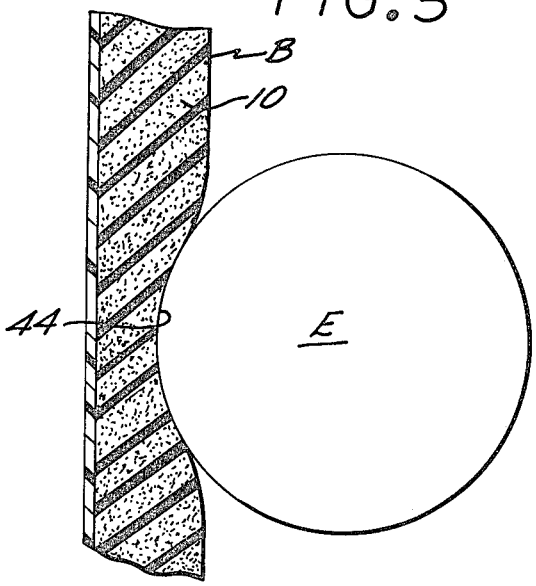
FIG. 5 is a fragmentary transverse cross-sectional view of a portion of the chest protector being laterally deformed after contact with a thrown baseball.

The protective pad B is formed from an elastomeric foamed organic material 10 that is deformed laterally when impacted by a thrown baseball E as shown in FIG. 5. The material 10 when struck by a baseball E will temporarily have an indentation 12 formed therein, but the material 10 chosen must have the physical characteristic that the pad B returns only slowly to its initial configuration after being so struck. Due to the material 10 being "dead" insofar as imparting any bounce to a baseball E striking the same, the baseball E after contacting the pad B will in most instances drop downwardly adjacent the feet of the catcher C where it may be easily recovered. This characteristic is in sharp contrast to previously available chest protectors that are sufficiently resilient that a baseball striking the same will bounce therefrom in an unpredictable direction, and cause the catcher to leave his normal position behind the home plate if he is to recover the baseball.

The protective pad B as may be seen in FIG. 1 includes a chest protecting portion 12 that has two laterally spaced first extensions 14 that are adjacently disposed to the shoulders of the catcher. The protective pad B also has a second extension 16 of greater width than the chest protecting portion 12 that extends downwardly from the latter a desired distance.

The protective pad B may be cast or formed from sheet resilient material 10. The material 10 may be any one of the numerous foamed polymerized resins or rubbers commercially available as of this date, providing that the material has a slow rate of recovery to its initial configuration after being struck by a baseball. One such material that is commercially available as of the present date is a foamed resin sold under the trade name "Belgium rubber". Such a material has a number of interconnected cells therein that are normally filled with air. When the material is physically deformed, air is ejected from the cells. The resiliency of the material tends to return it to its initial configuration after being deformed. Such a return is not possible until air from the ambient atmosphere flows into the cells which takes time. As a result the material has a slow rate of recovery.

Foamed resins and rubbers 10 due to the myriad interconnected cells filled with air are good heat insulators and when a protective pad B thereof is held close to the body of a catcher C the pad may cause the latter to perspire excessively. The protective pad B as may be seen in FIG. 1 preferably has a number of horizontal and vertically spaced openings 18 extending transversely therethrough. The openings 18 permit air to circulate therethrough to the body of catcher C to minimize perspiration.

The material 10 due to the cellular and porous nature tends to absorb moisture including perspiration. To render the protective pad B impervious to moisture and perspiration, the pad after openings 18 therein has a film 20 of a resilient polymerized resin coating the side thereof adjacent the body of the catcher to serve as a barrier to prevent the material absorbing perspiration from the catcher. The film 20 is applied to the exterior surface of protective pad B by dipping the latter into a bath of a commercially available organasol and then curing the deposited film to the solid state by the application of heat or the use of a catalyst. The deposited film 20 should not only be water impervious but tough and resistant to the abrasion it will receive when it is packed with other baseball gear and moved from place to place. Alternately, a liquid vinyl resin may be sprayed onto the protective pad B to define the film 20 and the resin solidifying when the solvent in the spray evaporates from the latter or a catalyst cause the resin in the spray to solidify. Although, numerous commercially available resins may be used to define the film 20, it is preferable to use a vinyl type resin due to the low cost thereof and the durability of such resins to abrasion.

The "Belgium Rubber" previously mentioned is ideally suited for the resilient material 10 as it is highly effective in absorbing shock. The "Belgium Rubber" is so effective that a one-inch thick sheet thereof has the same cushioning effect when used as a wrestling mat as a four-inch thick pad of horsehair.

Two sets of first U-shaped tabs 22 are secured to opposite sides of the first extensions 14 by an epoxy cement or the like, and with the tabs extending upwardly from the extensions. Two sets of second U-shaped tabs are likewise secured to opposite sides of the second extension and project outwardly therefrom in opposite directions. The first and second sets of tabs 22 and 24 extend through two sets of first and second rings 26 and 28, which rings serve as anchors for the harness D to be removably secured to the protective pad B.

The harness D as best seen in FIG. 1 includes a conventional longitudinally adjustable elastic or leather belt 30 that has first and second ends, with the first end having a first quick release fastener 32 secured thereto that may be removably secured to one of the second rings 28. The second end of the belt 30 terminates in a loop 34 which as may be seen in FIG. 1 engages the other one of the second rings 28.

A pair of shoulder straps 36 are provided that have first ends, with one of the first ends terminating in a loop 37 that engages one of the first rings 26, and the other first end of the shoulder straps supporting a quick release fastener 38 that may removably engage one of the first rings 26. The second ends of the shoulder straps are by stitching or the like permanently secured to the upper portion of a sheet 40 that is formed from leather, elastic or other tough material. The sheet 40 has a pair of laterally spaced slits 42 therein through which the belt 30 extends as shown in FIG. 1. The harness D above-described serves to hold the pad B in a protective position on the catcher C as shown in FIG. 4.

The thickness of the protective pad B is of importance. The material 10 deforms three dimensionally when struck by a thrown baseball E. When the thrown baseball E temporarily forms a concavity 44 in the material 10, the material previously in the concavity tends to be forced transversely and laterally away from the concavity. The material so forced away from the concavity 44 is compressed and air in the cells thereof is ejected therefrom.

The material 10 is resilient and tends to return the pad B to its initial configuration. However, the pad B cannot return to its initial configuration until the cells that have had air dispelled therefrom again fill with air from the ambient atmosphere which takes time. As a result, the pad B has a slow rate of recovery. Due to this slow rate of recovery a baseball E striking the pad B will dissapate substantially all of its kinetic energy in deforming the pad B to define the concavity 44, and due to the slow rate of recovery of the material 10 to its initial configuration the material exerts substantially no force on the baseball E. The baseball E as a result drops to the ground adjacent the catcher C rather than bouncing from the pad B in an unpredictable direction.

The force exerted by the thrown baseball E is transmitted to the pad B through the portion **44*a* of the surface of the baseball that contacts the pad. The more resilient the material 10 the greater will be the depth of the concavity 44*a* formed therein. As the depth of the concavity 44 increases, the greater will be the quantity of the material 10 that is deformed laterally away from the concavity. This increase in lateral deformation of the material 10** dissipates a major portion of the kinetic energy of the thrown baseball, and only a minor portion of the kinetic energy being transferred transversely through the pad B to the body of catcher C.

Accordingly, the degree of resiliency of the material 10 and the thickness of the pad B must be so related that when a thrown baseball E makes a concavity 44 in the material, the major portion of the kinrtic energy of the baseball will be dissipated in laterally deforming the material 10, and only a minor portion of the kinetic energy transmitted transversely through the pad to an area of the pad in forceful contact with the body of the catcher C. The magnitude of the force exerted on this area per square inch must be sufficiently low that it will not injure the body of the catcher C.

Figure 3:
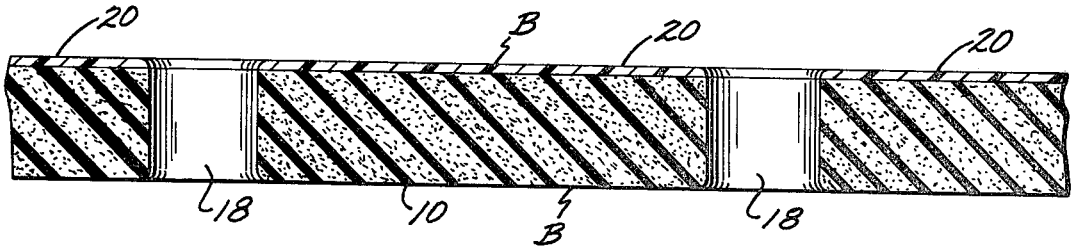
FIG. 3 is a fragmentary cross-sectional view of the protective pad taken on the line 3—3 of FIG. 1.

Due to air escaping from the interconnected cells of the material 10 when the latter is deformed, the film 20 should cover only the side of the pad adjacent the catcher C and the edges of the pad. If the film 20 completely envelops the pad B, the air in the interconnected cells is trapped within the envelope and cannot escape therefrom. The pad B under such conditions would have the resiliency thereof increased. Such an increase in resiliency is undesirable, as the thrown baseball E would tend to rebound from the pad B in an unpredictable direction rather than dropping to the ground. As occurs when a portion of the kinetic energy of the baseball is dissipated in ejecting air from the interconnected cells to the ambient atmosphere. The slow recovery of the material 10 to its initial configuration is due to the time it takes air from the ambient atmosphere to flow into the collapsed interconnected cells that have a negative pressure therein. Interconnected cells **10*a* that are in communication with the ambient atmosphere are shown in FIG. 3**.

The structure and operational advantages of the baseball catcher's chest protector has been described previously in detail and need not be repeated.

What is claimed is:

1. A lightweight, perspiration impervious baseball catcher's chest protector that causes a thrown baseball striking the same to drop to the ground adjacent the catcher and said protector allowing flow of air from the ambient atmosphere to the catcher's body, said chest protector of the type that includes a protective pad that extends across at least the chest of the catcher and a harness that removably supports said pad on said catcher, with said pad being characterized by being formed from a sheet of a foamed resilient organic material that has a section thereof deform transversely and laterally into a concavity when struck by a thrown baseball, with the major portion of the kinetic energy of said baseball being dissipated in laterally deforming said sheet, and said material having a sufficiently slow rate of recovery to its initial configuration that said baseball does not tend to bounce therefrom but instead drops to the ground adjacent said catcher, and a plurality of spaced transverse openings in said sheet through which air from the ambient atmosphere may circulate to the cather's body adjacent said pad; and a film of a pliable polymerized water impervious, abrasion resistant resin that covers said sheet on the side adjacent the body of said catcher to prevent said sheet from absorbing perspiration from said catcher.

2. A baseball catcher's chest protector as defined in claim 1 in which said pad is sufficiently thick that the major portion of the kinetic energy of said thrown baseball is dissipated in laterally deforming said sheet and but a minor portion of said kinetic energy being transferred transversely through said sheet to the body of said catcher, and said minor portion so transferred being spread out over a sufficiently large area of said sheet in contact with the body of said catcher that the latter is not injured.

3. A baseball catcher's chest protector as defined in claim 2 in which said sheet is formed from a resilient organic material that has a plurality of interconnected cells therein that are normally full of air, with said air being forced from said cells at the area of impact by a thrown baseball for said sheet to assume a concavity, and said sheet slowly returning to its initial configuration after impact by said baseball as air from the ambient atmosphere flows into said cells from which it was ejected.

4. A lightweight, perspiration impervious baseball catcher's chest protector that causes a thrown baseball striking the same to drop to the ground adjacent the catcher and said protector allowing flow of air from the ambient atmosphere to the catcher's body, said chest protector of the type that includes a protective pad that extends across at least the chest of the catcher and a harness that removably supports said pad on said catcher, with said pad being characterized by being formed from a sheet of a foamed resilient organic material that has a section thereof deform transversely and laterally into a concavity when struck by a thrown baseball, with the major portion of the kinetic energy of said baseball being dissipated in laterally deforming said sheet, with said material having a plurality of interconnected cells therein that are normally filled with air, said material at the area of impact by a thrown baseball having a substantial portion of the air ejected from a plurality of first cells adjacent thereto, and said sheet returning slowly to its initial configuration as air from the ambient atmosphere flows into said first cells, with the rate of recovery of said sheet to its initial configuration sufficiently slow that said thrown baseball does not bounce therefrom but drops to the ground adjacent said catcher, said sheet having means therein for allowing flow of air to the catcher's body.

5. A baseball catcher's chest protector as defined in claim 4 in which said air flow means comprises a plurality of spaced openings therein to permit circulation of air therethrough from the ambient atmosphere to the body of said catcher.

6. A baseball catcher's chest protector as defined in claim 5 which in addition includes a film of pliable water impervious polymerized resin that covers at least the side of said sheet adjacent the body of said catcher to prevent said sheet absorbing perspiration from the body of said catcher.

* * * * *